US006287391B1

(12) United States Patent
Kanekiyo et al.

(10) Patent No.: US 6,287,391 B1
(45) Date of Patent: Sep. 11, 2001

(54) METHOD OF PRODUCING LAMINATED PERMANENT MAGNET

(75) Inventors: Hirokazu Kanekiyo, Kyoto; Satoshi Hirosawa, Otsu, both of (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

(21) Appl. No.: 09/242,826

(22) PCT Filed: Jun. 25, 1998

(86) PCT No.: PCT/JP98/02830

§ 371 Date: Feb. 24, 1999

§ 102(e) Date: Feb. 24, 1999

(87) PCT Pub. No.: WO99/00802

PCT Pub. Date: Jan. 7, 1999

(30) Foreign Application Priority Data

| | | |
|---|---|---|
| Jun. 26, 1997 | (JP) | 9-187823 |
| Jul. 4, 1997 | (JP) | 9-195152 |
| Jul. 15, 1997 | (JP) | 9-207167 |
| Jul. 15, 1997 | (JP) | 9-207168 |

(51) Int. Cl.[7] ..... H01F 1/057

(52) U.S. Cl. ..... 148/101; 148/527; 164/463; 164/475

(58) Field of Search ..... 148/101, 102, 148/103, 527; 164/463, 475

(56) References Cited

U.S. PATENT DOCUMENTS

| | | | | |
|---|---|---|---|---|
| 4,402,770 | * | 9/1983 | Koon | 148/302 |
| 4,935,075 | * | 6/1990 | Mizoguchi et al. | 148/302 |
| 5,309,977 | * | 5/1994 | Yoneyama et al. | 164/663 |

FOREIGN PATENT DOCUMENTS

| | | | |
|---|---|---|---|
| 1-261803 | * | 10/1989 | (JP) . |
| 07-188704 A | * | 7/1995 | (JP) . |

* cited by examiner

*Primary Examiner*—John Sheehan
(74) *Attorney, Agent, or Firm*—Dymeka Gossett PLLC

(57) ABSTRACT

A method for manufacturing a permanent magnet by fabricating rapidly cooled alloy thin strip of amorphous composition which has good tenacity, simple working properties and an average thickness of 10 μm~200 μm, from a molten alloy of a specific composition containing 6 at % or less of rare-earth element and 15 at %~30 at % of boron, by means of specific rapid cooling conditions, and then subjecting this rapidly cooled alloy thin strip, after cutting or punching to a prescribed shape, to crystallization heat treatment such that the average crystal grain size thereof becomes 10 nm~50 nm, and by layering together two or more of these thin permanent magnets and bonding and uniting the layered thin strips by means of an inorganic adhesive material or a resin, it is possible readily to provide a high-performance layered permanent magnet having a desired thickness and a prescribed shape, without using a method involving crushing and bonded magnet forming processes and without needing to carry out a cutting process after manufacture.

4 Claims, 4 Drawing Sheets

METHOD OF PRODUCING LAMINATED PERMANENT MAGNET

FIELD OF THE INVENTION

This invention relates to a method for manufacturing a layered permanent magnet suitable for various types of small-scale motors, actuators, magnetic circuits for magnetic sensors, or the like, and more particularly, it relates to a method for manufacturing a layered permanent magnet having a prescribed shape, such as a plate shape, curved arc shape, ring shape, or the like, a thickness of 20 μm or above, and hard magnetic properties of iHc≧2 kOe, Br≧8 kG, by fabricating easily workable amorphous thin strip having high tenacity and an average thickness of 10 μm~200 μm from a molten alloy of a specific composition containing 6 at % or less of rare-earth element and 15 at %~30 at % of boron, by means of specific molten alloy rapid cooling conditions, providing a metallic layer of solder, or the like, on the surface of this thin strip, for example, then layering this amorphous thin strip, either directly or after cutting or punch processing to a desired shape, in such a manner that it forms a desired thickness, applying crystallization heat treatment such that the average crystal grain size becomes 10 nm~50 nm and the metallic layers melt, thereby uniting the strips into a single body.

BACKGROUND ART

At present, in applications in the field of domestic electrical appliances, OA equipment, and other electrical apparatus, demands for ever higher levels of performance and compactification are being met by cutting and machining rare-earth-type sintered magnets, which have superior magnetic properties, to desired shapes, or forming rare-earth-type bonded magnets to desired shapes, instead of using conventional hard ferrite magnets.

Although high-precision permanent magnets fabricated by cutting and machining sintered magnets give high performance, they have a drawback in that they are very expensive compared to conventional hard ferrite magnets, regardless of the type of material used. Moreover, the minimum processing thickness is limited to approximately 0.2 mm, and it is not possible to manufacture a magnet having a smaller thickness than this.

Bonded magnets, on the other hand, are manufactured, for example, into flat magnets having a diameter of 3 mm and a thickness of 0.3 mm, and are used as permanent magnets for miniature stepping motors in clocks, but since this involves pressure moulding of resin and magnetic particles having a grain size of 50 μm~300 μm, it is difficult to obtain a moulded product having a thickness of less than 0.1 mm, for example. In particular, in ring magnets, there is a minimum thickness limit of approximately 0.8 mm, when using a method where the magnet is compressed by a punch in a direction perpendicular to its thickness.

Moreover, in cases where a magnet is formed having a long direction in the direction of compression, the pressure is not transmitted uniformly due to frictional resistance between the magnetic powder and the die casting surface, and it is difficult to mould a long product having a small thickness. Recently, it has been reported that long ring magnets having a thickness of 0.5 mm can be manufactured by extrusion moulding of a bonded magnet, but the magnetic properties are degraded in proportion of the ratio of resin, and even at most, the residual density of magnetic flux Br is 7 kG and the maximum energy product (BH)max is in the order of 9.9 MGOe.

Conventionally, 2–17 type Sm-Co alloy powder is used as the magnetic powder for a bonded magnet, but recently, Nd—Fe—B type alloy powder manufactured by an HDDR method has been used as the magnetic powder for bonded magnets. The aforementioned powders are both magnetic powders which were developed for use in bonded magnets, and it is not possible to form these powders into permanent magnets by processing the powders themselves.

Moreover, at present, in many cases, an isotropic magnetic powder, such as an Nd—Fe—B type powder, manufactured by a molten alloy rapid cooling method, is used as a bonded magnet powder, but since this material is obtained in the formed of thin flakes consisting of a crystalline material by means of rapid cooling of a molten alloy, it is extremely brittle and cannot be formed to any desired shape by flexible bending or a punching process, and hence it is limited to use as a magnetic powder for bonded magnets.

Moreover, although cost reductions can be achieved by manufacturing a bonded magnet since a desired shape can be obtained without the cutting processing required for sintered magnets, because Nd—Fe—B magnetic powder of average particle size approximately 150 μm is combined by means of a resin, in cases where the magnetic powder may disperse readily, for instance, when the magnet is used in an HDD motor, there is a high risk that the recording medium will be damaged by the dispersed powder, and it is necessary to take countermeasures, such as surface coating, or the like, in order to prevent dispersion of the powder.

Moreover, since the Nd—Fe—B magnetic powder is a crushed powder obtained by crushing rapidly cooled alloy thin strip, the cut surfaces of the crushed powder are highly active and oxidize readily compared to the surfaces of rapidly cooled thin strip, and if no surface coating is provided in order to prevent oxidation and the powder is left for 1000 hours under environmental conditions of 80° C. and relative humidity 90%, then in the case of a magnet having a permanence coefficient Pc of 1, not only will the magnetic flux density be reduced by approximately 2% due to the effects of oxidation, but rusting will also occur on the surface, causing powder to become detached.

On the other hand, recently, in an Nd—Fe—B type magnet, a magnetic material having as a main phase an $Fe_3B$ type compound in an approximate $Nd_4Fe_{77}B_{19}$(at %) composition has been proposed by R. Coehoorn, et. al., J. de Phys. C8, 1988, pp.669~670), and the technical details thereof have been disclosed in U.S. Pat. No. 4,935,074. Prior to this, Koon had proposed, in U.S. Pat. No. 4,402,770, a method for manufacturing a permanent magnet composed of very fine crystals by applying crystallization heat treatment to an La—R—B—Fe amorphous alloy containing La as an essential element.

In recent years, it has been reported that thin flakes having hard magnetic properties can be obtained by heat treatment at 700° C. of amorphous flakes obtained by spraying molten Nd—Fe—B—V—Si alloy containing 3.8 at %~3.9 at % of Nd onto a rotating Cu roll, as disclosed by Richter et. al. in EP Patent 558691 B1. These permanent magnetic materials have a semi-stable structure comprising a mixed crystal composition combining an $Fe_3B$ phase, which is a soft magnetic material, and an $R_2Fe_{14}B$ phase, which is a hard magnetic material, obtained by applying crystallization heat treatment to amorphous flakes having a thickness of 20 μm~60 μm.

These permanent magnetic materials have a Br figure of approximately 10 kG and iHc of 2 kOe~3 kOe, and since their content of Nd, which is an expensive material, is of the order of 4 at %, the cost of the combined starting materials is less expensive that Nd—Fe—B magnets which have a main phase of $Nd_2Fe_{14}B$, and hence they are superior to conventional rare-earth magnets in terms of cost-to-performance ratio and have been proposed as alternative materials to hard ferrite magnets, although they are restricted to use as bonded magnets, similarly to conventional Nd—Fe—B bonded magnets having a main phase of $Nd_2Fe_{14}B$.

However, even when a magnetic powder having high magnetic properties is used in a bonded magnet, since it is difficult to raise the content ratio of the magnetic powder above 80%, high magnetic properties cannot be expected of a bonded magnet, and in the case of small-scale bonded magnets, in particular, a maximum isotropic figure of approximately 10 MGOe is obtained.

DISCLOSURE OF THE INVENTION

It is an object of this invention to provide a method for manufacturing a permanent magnet whereby a permanent magnet of a desired curved shape, such as a small-scale, thin arc-shaped or ring-shaped magnet, which is optimal for a magnetic circuit used in an acceleration sensor, for example, and having any desired thickness, can be manufactured such that magnetic properties superior to those of a bonded magnet can be utilized effectively, by arriving at a method for manufacturing a fine crystal-type permanent magnet having hard magnetic properties of iHc≧2 kOe and Br≧8 kG by applying crystallization heat treatment to an amorphous thin strip obtained from a molten alloy of a specific composition by means of specific rapid cooling conditions, such that the average crystal grain size becomes 10 nm~50 nm.

As a result of various research aimed at finding a permanent magnet having superior magnetic properties to a bonded magnet which can be processed to a desired shape having any thickness, the present inventors focussed their attention on the fact that a rapidly cooled alloy thin strip of amorphous composition and average thickness 10 μm~200 μm, obtained from a molten alloy of a specific composition containing 6 at % or less of rare-earth element and 15 at %~30 at % of boron by means of specific molten alloy rapid cooling conditions, has excellent tenacity and elastic deformation characteristics, and they discovered that a layered permanent magnet having a prescribed shape and a desired thickness can be obtained without using a method involving crushing and bonded magnet formation processes, by forming a metal layer of solder, or the like, on the surface of the aforementioned thin strip, layering two or more strips of the rapidly cooled alloy thin strip together to form a desired thickness, either directly or after cutting to a desired length or machining to a desired shape, and carrying out magnetic hardening treatment by means of crystallization heat treatment to form a permanent magnet having hard magnetic properties of iHc≧2 kOe, Br≧8 kG, whilst simultaneously causing the permanent magnet thin strips to bond together and form a single body by means of the melted solder.

The present inventors also discovered that a high-performance layered permanent magnet having a prescribed shape and a desired thickness can be obtained, by applying magnetic hardening treatment by means of crystallization heat treatment to the aforementioned rapidly cooled alloy thin strip, either directly or after cutting to a prescribed length or machining to a prescribed shape, layering two or more of such strips together to form a desired thickness, and causing the layered permanent magnet thin strips tube bonded together and formed into a single body by means of an epoxy resin.

The present inventors also discovered that a high-performance layered permanent magnet having a prescribed shape and a desired thickness can be obtained, by applying an inorganic adhesive material to the surfaces of rapidly cooled alloy thin strips fabricated by the aforementioned method, layering such strips together to form a desired thickness, and applying crystallization heat treatment thereto, such that a permanent magnet is formed whilst simultaneously the inorganic adhesive material between the thin strips hardens and bonds, forming a single body.

The present inventors also discovered that an arc-shaped permanent magnet having any thickness of 20 μm or above can be obtained, by layering two or more strips of the rapidly cooled alloy thin strip fabricated by the aforementioned method to form a desired thickness, either directly of after cutting to a desired length or machining to a desired shape, and applying magnetic hardening treatment thereto by crystallization heat treatment whilst holding the aforementioned strips in a curved position by means of a holding tool, the thin strips having undergone crystallization retaining a curved shape after being released from the holding tool, and the layered thin strips being bonded together.

The present inventors also discovered that a ring-shaped permanent magnet having any thickness of 20 μm or above can be obtained by applying magnetic hardening treatment by means of crystallization heat treatment to rapidly cooled alloy thin strips fabricated by the aforementioned method, whilst the strips are held in a coiled shape comprising two or more turns of a toroidal shape, the thin strips having undergone crystallization and coiled into two or more turns of a toroidal shape retaining a ring shape even when not held in a holding tool, and the layered thin strips being bonded together.

The present inventors also discovered that a layered permanent magnet having a prescribed shape and a desired thickness can be obtained by layering together rapidly cooled alloy thin strips fabricated by the aforementioned method, and applying crystallization heat treatment thereto whilst simultaneously moulding to a desired shape and bonding by means of a hot isostatic pressing (HIP) device or a hot pressing (HP) device, and thus they completed the present invention.

BEST MODE FOR CARRYING OUT THE INVENTION

Figure 1:
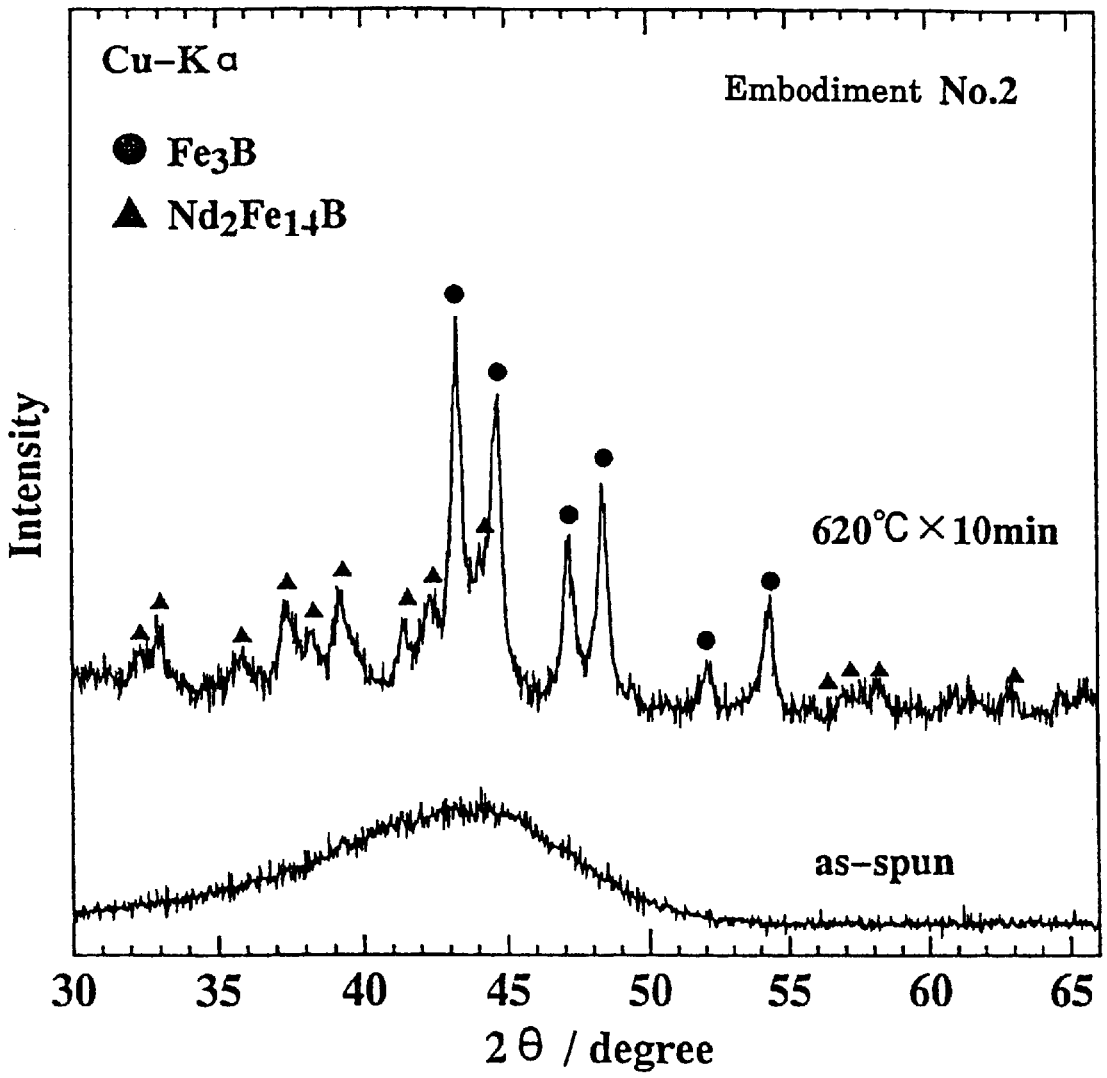
FIG. 1 is a graph showing powder X-ray diffraction patterns before and after crystallization heat treatment of the rapidly cooled alloy thin strips according to No. 2 in Table 1 and Table 4.

In this invention, a rapidly cooled alloy thin strip having excellent tenacity and elastic deformation characteristics, an average thickness of 10 μm~200 μm, and 90% or above amorphous composition, is manufactured by applying a rapid cooling method using a rotating roll, in an inert gas atmosphere of 30 kPa or below, to a molten alloy, which may be expressed by any one of the following compositional formulae:

$$Fe_{100-x-y}R_xA_y$$

$$(Fe_{1-m}Co_m)_{100-x-y}R_xA_y$$

$$Fe_{100-x-y-z}R_xA_yM_z$$

$$(Fe_{1-m}Co_m)_{100-x-y-z}R_xA_yM_z$$

(where R is one or two or more elements selected from Pr, Nd, Dy and Tb; A is one or two elements selected from C and B; and M is one or two or more elements selected from Al, Si, Ti, V, Cr, Mn, Ni, Cu, Ga, Zr, Nb, Mo, Ag, Hf, Ta, W, Pt, Au, Pb), and wherein the symbols x, y, z, m limiting the compositional range satisfy the values given below.

$1 \leqq x < 6$ at %

$15 \leqq y \leqq 30$ at %

$0.01 \leqq z \leqq 7$ at %

$0.01 \leqq m \leqq 0.5$

REASONS FOR COMPOSITIONAL LIMITS

In this invention, there are the following reasons for the limits stated for the composition of the rapidly cooled alloy thin strip.

With regard to the rare-earth element R, high magnetic properties are obtained only when there is a specific content of one element or two or more elements selected from Pr, Nd, Dy and Tb, and properties in excess of an iHc figure of 2 kOe are not obtained when using Ce or La, for example. Furthermore, with the exception of Tb and Dy, medium rare-earth elements from Sm onwards, and heavy rare-earth elements, cause magnetic properties to decline and are therefore undesirable. If the R content is less than 1 at %, then an iHc of 2 kOe or above cannot be obtained, whilst if the R content exceeds 6 at %, a Br value of 8 kG or above cannot be obtained, and hence a range of 1 at %~6 at % is set for the R content. A more desirable range is 2 at %~5.5 at %.

With regard to A, if the total content of the C and/or B is less than 15 at %, then there will be marked precipitation of α-Fe in the metal composition after rapid cooling of the molten alloy, thereby impeding precipitation of compounds containing an $Nd_2Fe_{14}B$ type crystal structure, which is essential for achieving coercive force, and therefore an iHc value of less than 1 kOe only is obtained, whilst if the content of A is over 30 at %, then the squareness of the demagnetizing curve is degraded severely. Consequently, the range for the content of A is set to 15 at %~30 at %, and desirably, 15 at %~20 at %.

With regard to the Fe, by replacing a portion of the Fe with Co in the remainder of the composition after the aforementioned elements, the metallic composition is made finer, the squareness of the demagnetizing curve is improved and increases in maximum energy product (BH)max and in thermal resistance characteristics are obtained, but these effects are not evident if the amount of Co is less than 0.1% with respect to the Fe, whilst if this amount exceeds 50%, a Br value in excess of 8 kG will not be obtained. Therefore, the substitution ratio of Co with respect to Fe is set to the range of 0.1%~50%, and desirably, 0.5%~10%.

The additional element M, namely, Al, Si, Ti, V, Cr, Mn, Ni, Cu, Ga, Zr, Nb, Mo, Ag, Hf, Ta, W, Pt, Au or Pb, contributes to achieving a finer composition in the fine crystal-type permanent magnet, and it also has the effect of increasing the coercive force, improving the squareness of the demagnetizing curve and increasing Br and (BH)max, but these effects are not evident if the concentration of M is less than 0.01 at %, whilst if this concentration is 7 at % or more, then magnetic properties of Br≧8 kG cannot be obtained. Consequently, a range of 0.01 at %~7 at %, and desirably, 0.05 at %~5 at %, is set for the concentration of M.

REASONS FOR MANUFACTURING CONDITION LIMITS

In the present invention, the following limits are placed on the manufacturing conditions relating to the rapidly cooled alloy thin strip.

In this invention, the most important factor is that permanent magnets of various shapes having hard magnetic properties of iHc≧2 kOe and Br≧8 kG and comprising layered fine crystal thin strip magnets of average thickness 10 μm~200 μm can be obtained by fabricating amorphous thin strip of average thickness 10 μm~200 μm having excellent tenacity and elastic deformation characteristics by applying a rapid cooling method using a rotating roll to a molten alloy of the aforementioned specific composition, in an inert gas atmosphere of 30 kPa or less, and then applying crystallization heat treatment to this amorphous thin strip, after cutting it and whilst holding it in a coiled state comprising two or more turns in a toroidal shape, such that the average crystal grain size thereof becomes 10 nm~50 nm.

In other words, it is undesirable if the rapid cooling atmosphere for the molten alloy is in excess of 30 kPa, since this will produce marked effects of the atmospheric gas infiltrating in between the rotating roll and the molten alloy, and therefore a uniform composition effectively comprising 90% or more amorphous material will not be obtained, making it impossible to achieve excellent tenacity and elastic deformation characteristics or to machine the rapidly cooled alloy thin strip to a desired shape. Since the atmospheric gas serves to prevent oxidation of the molten alloy, an inert gas atmosphere is used. Desirably, an Ar gas atmosphere is used.

For the material of the rotating roll used in rapid cooling of the molten alloy, from the viewpoint of thermal conductivity, it is possible to use an aluminium alloy, pure copper, copper alloy, iron, brass, tungsten, or bronze, and from the viewpoint of mechanical strength and economy, Cu or Fe (including alloys containing Cu and Fe) are desirable. Materials other than those given above are undesirable, since they do not allow the molten alloy to cool sufficiently due to their poor thermal conductivity, and hence a uniform composition containing effectively 90% or more of amorphous material cannot be obtained.

Examples of the rapid cooling method using a rotating roll include a single roll rapid cooling method, and a dual roll rapid cooling method, but any rapid cooling method may be adopted, provided that it allows the manufacture of amorphous thin strip of average thickness 10 μm~200 μm having excellent tenacity and elastic deformation characteristics.

For example, if a single roll rapid cooling method is adopted wherein a Cu roll having surface coarseness of centre line coarseness Ra≦0.8 μm, maximum height Rmax≦3.2 μm and 10-point average coarseness Rz≦3.2 μm is used for the rotating roll, then if the rolling circumference speed is less than 10 m/s, it is not possible to obtain an amorphous thin strip of average thickness 10 μm~200 μm having excellent tenacity and elastic deformation characteristics and a critical radius of 10 mm or less which can be bent without damage, and therefore a rolling circumference speed of 10 m/s or above is desirable. A preferable rolling circumference speed is in the range of 15 m/s~50 m/s.

METHOD FOR MANUFACTURING LAYERED PERMANENT MAGNET

The manufacturing method used for obtaining layered permanent magnets of various shapes having a desired thickness of 20 μm or above in this invention is described below.

CASE 1

A rapidly cooled alloy thin strip of amorphous composition and average thickness 10 μm~200 μm and having excellent tenacity and elastic deformation characteristics obtained by means of the aforementioned molten alloy rapid cooling conditions is taken, molten metal is plated or vapour deposited thereonto at 550° C. or less, two or more strips of this rapidly cooled alloy thin strip are layered together to form a desired thickness, and crystallization heat treatment is applied at a crystallization heat treatment temperature of 550° C.~750° C. such that the average crystal grain size is 10 nm~50 nm, during which process the metal layers plated or vapour deposited onto the surface of the thin strips are simultaneously caused to melt, thereby causing the thin strips to bond tightly together and unite into a single body.

The metal used for plating or vapour deposition onto the rapidly cooled alloy thin strip should be a metal having a melting point at or below 550° C., this being the crystallization temperature of the amorphous thin strip, and with regard to effects on people and the environment and ease of handling, Zn and solder are desirable metals to use. Moreover, if the amount of metal plated or vapour deposited is a ratio of 10 wt % or more with respect to the permanent magnet, then it will not be possible to obtain a Br value of 8 kG or above, which is undesirable, whilst if this amount is 0.01 wt % or less, then the layered permanent magnet thin strips will not bond together. Consequently, the amount of metal is restricted to 0.01 wt %~10 wt % and desirably, it is in the range of 0.5 wt %~5 wt %.

A layered permanent magnet of a desired shape is obtained by layering together two or more strips of the aforementioned rapidly cooled alloy thin strips onto which metal has been plated or vapour deposited, after cutting or machine processing of the strips, such that a desired thickness is formed, whereupon crystallization heat treatment is applied thereto such that the average crystal grain size becomes 10 nm~50 nm, during which process the plated or vapour deposited metal layers are simultaneously caused to melt, thereby causing the processed rapidly cooled alloy thin strips to bond together tightly and unite into a single body.

CASE 2

A permanent magnet having any thickness of 20 μm or above can be manufactured by forming fine crystal-type permanent magnet thin strip by applying crystallization heat treatment to rapidly cooled alloy thin strip of amorphous composition and average thickness 10 μm~200 μm and having excellent tenacity and elastic deformation characteristics obtained by means of the aforementioned molten alloy rapid cooling conditions, in such a manner that the average crystal grain size thereof becomes 10 nm~50 nm, and then either layering two or more strips of the permanent magnet thin strip to form a desired thickness, immersing the strips in epoxy resin and causing the epoxy resin to set by means of heat treatment, or alternatively, coating an inorganic adhesive material onto the surfaces of rapidly cooled alloy thin strips as obtained in the aforementioned manner, layering together two or more of these strips to form a desired thickness, and applying the aforementioned crystallization heat treatment, causing the inorganic adhesive material to set and thereby bonding the strips into a single body.

Moreover, a layered permanent magnet of a desired shape having any thickness of 20 μm or above is obtained by cutting or punching the aforementioned amorphous thin strip to a desired shape, forming the strip into a thin permanent magnet by applying crystallization heat treatment such that the average crystal grain size becomes 10 nm~50 nm, and then either layering two or more strips of the permanent magnet thin strip to form a desired thickness, immersing the strips in epoxy resin and causing the epoxy resin to set by means of thermal processing, or alternatively, coating an inorganic adhesive material onto the surfaces of alloy thin strips after forming them to the desired shape, layering together two or more of these strips to form a desired thickness, and applying the aforementioned crystallization heat treatment, causing the inorganic adhesive material to set, thereby bonding the strips into a single body.

In the process of forming the amorphous thin strip to a desired shape by means of cutting or machine processing in case 1 and case 2, since thin strip which has undergone crystallization heat treatment loses tenacity and elastic deformation characteristics and since mechanical processing using a punch, or the like, will cause this thin strip to break and not process it to the required shape, it is desirable to use a method whereby crystallization heat treatment is carried out after the amorphous thin strip having excellent tenacity and elastic deformation characteristics has been processed to the desired shape. Moreover, if a method other than mechanical processing, such as ultrasound machining, or the like, is used, then processing may be carried out even after crystallization heat treatment has been applied to the strips, without problems such as breakage, or the like.

The aforementioned rapidly cooled alloy thin strip comprising over 90% amorphous material must be subjected to crystallization heat treatment in order that a fine crystal metallic composition having an average crystal grain size of 10 nm~50 nm and displaying hard magnetic properties of iHc≧2 kOe and Br≧8 kG is obtained, but if the heat treatment temperature is less than 550° C., then there will be no precipitation of $Nd_2Fe_{14}B$ which is essential for generating coercive force, and hence an iHc figure of less than 1 kOe will be obtained, whilst if the temperature exceeds 750° C., then there will be marked particle growth, the average grain size will exceed 50 nm, and hence iHc, B and the squareness of the demagnetizing curve will be degraded and the aforementioned magnetic properties will not be obtained. Consequently, a treatment temperature in the range of 550° C.~750° C. is preferable. Here, desirably, the average crystal grain size in the fine crystal composition obtained by heat treatment between 550° C.~750° C. should be as small as possible, but if it is less than 10 nm, this may cause the iHc value to decline, so a lower limit of 10 nm is set.

Desirably, heat treatment is carried out in an inert gas atmosphere of Ar gas, $N_2$ gas, or the like, or in a vacuum of pressure 1.33 Pa or less, in order to prevent oxidation. The magnetic properties are not dependent on the heat treatment time, but if treatment exceeds 6 hours in length, then there is a tendency for the Br content to decline slightly with the passage of time, and hence a treatment time of less than 6 hours is desirable.

CASE 3

An arc-shaped permanent magnet of thickness 20 μm~500 μm which retains a curved shape after crystallization even after being released from a holding tool is obtained by cutting the amorphous thin strip obtained above to a desired length, layering together two or more of such strips, and applying crystallization heat treatment whilst holding the strips in a prescribed shape by means of a holding tool, such that the average grain size thereof becomes 10 nm~50 nm.

As a method for bonding together the aforementioned layered fine crystal thin strips, a method may be used whereby a resin is introduced in between the layered thin strips after crystallization heat treatment, and as the resin used here, it is possible to employ any nylon, phenol or epoxy resin, or the like. If epoxy resin is used, for example, then epoxy resin dissolved in an alcohol, or the like, is introduced in between the layered thin strips, whereupon heat treatment is applied at the temperature at which the epoxy resin sets (approximately 150° C.), thereby bonding the layered thin strips together.

It is also possible to use a method whereby an inorganic resin comprising zirconia, silica or alumina dissolved in a solvent is coated onto the amorphous thin strip prior to crystallization heat treatment, whereupon two or more of such strips are layered together and are bent to a prescribed shape and crystallization heat treatment is applied, during which process the inorganic adhesive simultaneously hardens, thereby bonding together the fine crystal magnetic thin strips.

Moreover, it is also possible to use a method whereby metal having a melting point of 550° C. or less is plated or vapour deposited onto amorphous thin strips, two or more of such strips are then layered together, and whilst being held in a curved shape by means of a holding tool, they are subjected to heat treatment at a crystallization temperature of 500° C.~750° C. such that the average crystal grain size thereof becomes 10 nm~50 nm, during which process the metal plated or vapour deposited onto the surface of the thin strip simultaneously melts and the thin strips are bonded together by means of the melted metal.

CASE 4

A ring-shaped permanent magnet of average thickness 20 μm~500 μm which maintains a ring shape coiled in a toroidal shape after crystallization, even when not held in a holding tool, is obtained by holding the amorphous strip obtained above in a state where it is wound on itself in two or more coils of a toroidal shape such that it forms a desired thickness, and then applying crystallization heat treatment such that the average crystal grain size thereof becomes 10 nm~50 nm.

As a method for bonding together the fine crystal thin strip wound in two or more coils, a method may be used whereby resin is introduced in between the layered thin strips after crystallization heat treatment, and as the resin used in this case, it is possible to employ any nylon resin, phenol resin, epoxy resin, or the like. If epoxy resin is used, for example, then epoxy resin dissolved in an alcohol, or the like, is introduced in between the layered thin strips, whereupon the layered thin strips are bonded together by heat treatment to a temperature at which the epoxy resin will set (approximately 150° C.).

It is also possible to use a method whereby an inorganic resin comprising zirconia, silica or alumina dissolved in a solvent is coated onto the amorphous thin strip prior to crystallization heat treatment, whereupon the strip is wound on itself in two or more coils of a toroidal shape such that this forms a desired thickness and crystallization heat treatment is then applied, during which process the inorganic adhesive simultaneously hardens, thereby bonding the fine crystal magnetic thin strip together.

Moreover, it is also possible to use a method whereby metal having a melting point of 550° C. or less is plated or vapour deposited onto the surface of amorphous thin strip, the strip is wound on itself in a toroidal shape in a ring-shaped tool such that two or more strips of the amorphous thin strip are layered together, and the strip is then subjected to heat treatment at a crystallization temperature of 500° C.~750° C. such that the average crystal grain size thereof becomes 10 nm~50 nm, during which process the metal plated or vapour deposited onto the surface of the thin strip simultaneously melts and the thin strips are bonded together by means of the melted metal.

The metal which is plated or vapour deposited onto the amorphous thin strip should be a metal having a melting point at or below 550° C., this being the crystallization temperature of the amorphous thin strip, and with regard to effects on people and the environment and ease of handling, Zn and solder are desirable for use as this metal.

In case 3 and case 4, if the amount of either the resin, inorganic adhesive, plated metal or vapour deposited metal used for bonding is more than 10 wt % as a ratio with respect to the permanent magnet, then a Br value in excess of 8 kG will not be obtained, which is undesirable, whilst if this amount is less than 0.01 wt %, it will not be possible to bond the layered permanent magnet thin strips together securely. Therefore, the amount of resin, inorganic adhesive material, plated metal or vapour deposited metal used for bonding is limited to 0.01 wt %~10 wt %, and more desirably, to 0.5 wt %~5 wt %.

The aforementioned thin strip containing 90% or more of amorphous material requires crystallization heat treatment in order to form a fine crystal metal composition of average crystal grain size 10 nm~50 nm whereby hard magnetic properties of iHc≧2 kOe, Br≧8 kG can be achieved, but if the heat treatment temperature is less than 550° C., an iHc figure of less than 1 kOe only will be obtained due to the lack of precipitation of $Nd_2Fe_{14}B$ which is essential for achieving coercive force. If this temperature exceeds 750° C., on the other hand, there will be marked particle growth, the average crystal grain size will exceed 50 nm, and hence iHc, Br and the squareness of the demagnetizing curve will deteriorate and the aforementioned magnetic properties will not be obtained. Consequently, a heat treatment temperature in the range of 550° C.~750° C. is desirable. Preferably, the average crystal grain size in the fine crystal composition obtained by heat treatment at 550° C.~750° C. should be as small as possible, but if it is less than 10 nm, this will cause a decline in the iHc value, and hence a lower limit of 10 nm is set.

Desirably, heat treatment is carried out in an inert gas atmosphere or Ar gas, $N_2$ gas, or the like, or a vacuum of 1.33 Pa or less, in order to prevent oxidation. Magnetic properties are not dependent on the heat treatment time, but if this time exceeds 6 hours, there is a tendency for the Br content to fall with the passage of time, and therefore a treatment time of less than 6 hours is desirable.

CASE 5

A layered magnet of a desired shape can be obtained by layering together rapidly cooled alloy thin strips obtained as above to a desired thickness, inserting the strips into a bag made from copper foil, which has been prepared previously, applying heat in a temperature range of 500° C.~700° C. at a rate of temperature rise of 5° C./minute or above, and applying a pressure of 30 MPa~200 MPa and holding for a time period of three minutes or more and less than 6 hours, by means of a hot isostatic pressing (HIP) device, followed by cooling.

Moreover, it is also possible to obtain a layered magnet of a desired shape by layering rapidly cooled alloy thin strips obtained as above, inserting the strips into a die cavity of a hot pressing (HP) device, and applying pressure of 30 MPa~200 MPa by means of a punch whilst heating to a temperature in the range of 500° C.~750° C. at a rate of temperature rise of 5° C./min or above, and holding for a time period of three minutes of more and less than 6 hours, followed by cooling.

Moreover, it is also possible to obtain a layered magnet of a desired shape using the manufacturing methods based on an HIP or HP device as described above, wherein the rapidly cooled alloy thin strip is effectively in a metallic glassy state where it has undergone some structural relaxation from an amorphous structure, and after compacting by means of plastic deformation between the glass transition temperature (Tg) and the crystallization temperature (Tx), the strip is crystallized at the crystallization temperature.

In the aforementioned manufacturing method, the rapidly cooled alloy thin strip is not liable to fracture if it is in an amorphous or metallic glassy state, and it is easy to process. Moreover, depending on the composition of the alloy, the glass transition temperature Tg may be lower than the crystallization temperature, which is particularly desirable, since at temperatures above Tg, the alloy will start to display superplasticity and hence it will be possible to achieve sufficient compaction at a relatively low pressure. At temperatures above Tx, since crystallization begins to proceed, superplasticity will not occur and a relatively high pressure will be required for compaction.

In the aforementioned manufacturing method using an HIP or HP device, if the applied temperature is less than 500° C., crystallization will not proceed, the coercive force required for use as a permanent magnet will not be generated, and moreover, since the glass transition temperature of the rapidly cooled alloy cannot be brought below 500° C., it is not possible to achieve compaction at a temperature below 500° C. If the temperature exceeds 750° C., then there is marked particle growth, the average grain size becomes 50 nm or more, and hence iHc, Br and the squareness of the demagnetizing curve decline and the desired magnetic properties cannot be obtained. Consequently, a temperature range of 500° C.~750° C. is set.

When heating the alloy to this temperature, if the rate of temperature change is less than 5° C./minute, then there is marked particle growth and magnetic properties are degraded, which is undesirable.

It is necessary to hold the alloy at the heating temperature for 3 minutes or more in order to obtain a uniform crystal composition, and if the alloy is held at this temperature for more than 6 hours, then magnetic properties will deteriorate due to the growth of crystal grains, even when the alloy is processed at the lowest possible temperature.

With regard to the pressure applied by the HIP or HP device, if the pressure is less than 30 MPa, then sufficient compaction will not occur, whilst if the pressure exceeds 200 MPa, then excessive plastic deformation will occur and it will become difficult to obtain the initial shape, and furthermore, the equipment required will be large in size. Consequently, the applied pressure is set in the range of 30 MPa~200 MPa.

Furthermore, in a high-speed rotational device, or the like, which uses a rare-earth sintered magnet, eddy currents generated inside the magnet cause the motor efficiency to decline, and they also produce marked increases in the temperature of the magnet, which causes performance to decline due to thermal demagnetization. It is therefore important that the electrical resistivity of the rare-earth sintered magnet is greater than 1 $\mu\Omega$.m in order to reduce eddy currents, thereby reducing loss and improving the stability of the rotating device.

Therefore, in this invention, by inserting a commonly known inorganic glass, a ceramic fibre material, a ceramic fibre material containing an inorganic adhesive or an inorganic glass, or a mixture of ceramic powder and inorganic glass, as electrical insulating layers between the rapidly cooled alloy thin strips and then layering and integrating the strips by means of the method in any of cases 1~5 above, it is possible to manufacture a layered permanent magnet having an electrical resistivity of 50 $\mu\Omega$.m or more in the direction in which the strips are layered.

Here, it is desirable that the material used for the insulating layers is an inorganic glass, such as borosilicate glass, or a ceramic fibre, a ceramic powder, or a mixture of these with an inorganic glass, said materials having high electrical resistivity and good combining properties with respect to metal.

EMBODIMENTS

Embodiment 1

The following metals, Fe, Co, C, Al, Si, Ti, V, Cr, Mn, Ni, Cu, Ga, Zr, Nb, Mo, Ag, Pt, Au, Pb, B, Nd, Pr, Dy, Tb having a purity of 99.5% or above were used according to the compositions No. 1~20 in Table 1, the total weight thereof being measured such that it was 30 g, the metals being placed in a quartz crucible having a slit measuring 0.3 mm×8 mm in the base thereof and being melted by high-frequency heating in an Ar atmosphere held at the rapid cooling atmospheric pressure indicated in Table 1.

After setting the molten temperature of the resulting alloy to 1300° C., the surface of the molten alloy was reduced to room temperature whilst applying pressure by Ar gas, and the molten alloy was cast in a continuous fashion from a height of 0.7 mm onto the outer surface of a rotating Cu roll, at the roll circumference speed and under the rapid cooling atmosphere conditions indicated in Table 1, thereby yielding continuous rapidly cooled alloy thin strip having a width of 8 mm and an average thickness of 10 $\mu$m~100 $\mu$m. It was confirmed by means of powder XRD diffraction that all of the rapidly cooled alloy thin strip thus obtained was amorphous. The average thickness of the rapidly cooled alloy thin strip obtained is indicated in Table 2.

This continuous rapidly cooled alloy thin strip was cut into thin strips measuring 8 mm width by 50 mm length, whereupon Zn of 99.9% purity was vapour deposited onto the rapidly cooled thin strip to a thickness of 4 $\mu$m at a film growth rate of 0.15 $\mu$m/min. Next, the rapidly cooled thin strip onto which Zn had been deposited was formed into rapidly cooled alloy thin plates having a surface of 5 mm×5 mm by punch processing using a 5 mm×5 mm punch, whereupon such plates were layered together until the average thickness was 0.2 mm, the plates were held for 10 minutes at the heat treatment temperature shown in Table 1, in an Ar gas flow, and they were then cooled to room temperature, thereby yielding a permanent magnet measuring 5 mm×5 mm×0.2 mm wherein the thin strips are held together by means of the melted Zn.

The magnetic properties of this magnet after magnetization by a 60 kOe pulse magnetizing field in the height direction of the permanent magnet (perpendicular direction to the 5 mm×5 mm surface) were evaluated in a closed magnetic path by means of a BH tracer. The magnetic properties of the magnet are shown in Table 3. In No. 3~No. 20, it was confirmed that the Co, Al, Si, Ti, V, Cr, Mn, Ni, Cu, Ga, Zr, Nb, Mo, Ag, Pt, Au or Pb, replaced a portion of the Fe in each of the compositional phases. FIG. 1 shows powder X-ray diffraction patterns before and after crystallization heat treatment for No. 2.

TABLE 1

| | Composition (at %) | | | | Roll Circumference Speed | Rapid Cooling Atmospheric Pressure | Heat Treatment Temperature |
|---|---|---|---|---|---|---|---|
| | Fe | A | R | M | m/sec | kPa | ° C. |
| | | | | Embodiment 1 | | | |
| 1 | 79.5 | B18.5 | Nd2 | — | 30 | 1.3 | 590 |
| 2 | 78.5 | B18.5 | Nd3 | — | 30 | 1.3 | 620 |
| 3 | 75 + Co3 | B17.5 | Nd3.5 + Pr1 | — | 40 | 1.3 | 640 |
| 4 | 70 + Co2 | B20 | Nd5 | V3 | 20 | 1.3 | 660 |
| 5 | 77 + Co3 | B15.5 | Nd4 | Zr0.5 | 20 | 1.3 | 640 |
| 6 | 66 + Co5 | B18.5 | Nd5.5 | Cr5 | 10 | 10 | 700 |
| 7 | 78 | B17 | Nd3 | Al2 | 20 | 10 | 600 |
| 8 | 76.5 | B18.5 | Nd4 | Si1 | 20 | 10 | 680 |
| 9 | 69 | B18.5 | Nd3.5 + Dy1 | Mn1 | 40 | 10 | 640 |
| 10 | 76 | B15 + C3 | Nd4.5 | Ni1.5 | 40 | 20 | 660 |
| 11 | 75 | B15 + C5 | Nd2.5 + Pr1 | Cu1.5 | 30 | 20 | 610 |
| 12 | 77 | B18.5 | Nd2 + Dy2 | Nb0.5 | 15 | 20 | 620 |
| 13 | 75.5 | B18.5 | Nd2 + Pr3 | Ga1 | 40 | 20 | 660 |
| 14 | 76.5 | B18.5 | Nd4 | Ag1 | 30 | 20 | 660 |
| 15 | 78 | B18 | Nd3.5 | Pt0.5 | 20 | 25 | 600 |
| 16 | 76.5 | B18.5 | Nd4.5 | Au0.5 | 20 | 25 | 640 |
| 17 | 75.5 | B18.5 | Nd4.5 + Tb0.5 | Pb1 | 50 | 30 | 680 |
| 18 | 75 | B7 + C10 | Nd5 | Pb3 | 40 | 1.3 | 640 |
| 19 | 75.5 | B18.5 | Nd5 | Ti1 | 40 | 1.3 | 650 |
| 20 | 77.5 | B15 + C2 | Nd4.5 | Ti1 | 40 | 1.3 | 640 |

TABLE 2

| | Average Thickness of Rapidly Cooled Thin sheet μm |
|---|---|
| | Embodiment 1 |
| 1 | 30 |
| 2 | 35 |
| 3 | 30 |
| 4 | 60 |
| 5 | 70 |
| 6 | 100 |
| 7 | 55 |
| 8 | 60 |
| 9 | 27 |
| 10 | 25 |
| 11 | 30 |
| 12 | 80 |
| 13 | 20 |
| 14 | 33 |
| 15 | 65 |
| 16 | 54 |
| 17 | 10 |
| 18 | 20 |
| 19 | 25 |
| 20 | 20 |

TABLE 3

| | Magnetic Properties | | |
|---|---|---|---|
| | Br (kG) | iHc (kOe) | (BH)max (MGOe) |
| | Embodiment 1 | | |
| 1 | 13.9 | 2.0 | 10.6 |
| 2 | 12.2 | 2.7 | 11.9 |
| 3 | 10.0 | 4.3 | 11.6 |
| 4 | 9.9 | 6.2 | 10.0 |

TABLE 3-continued

| | Magnetic Properties | | |
|---|---|---|---|
| | Br (kG) | iHc (kOe) | (BH)max (MGOe) |
| 5 | 12.6 | 4.5 | 12.9 |
| 6 | 10.5 | 7.1 | 12.6 |
| 7 | 12.9 | 3.1 | 15.4 |
| 8 | 12.1 | 3.5 | 15.4 |
| 9 | 10.6 | 4.0 | 13.4 |
| 10 | 11.0 | 4.5 | 13.1 |
| 11 | 12.2 | 3.5 | 13.9 |
| 12 | 11.4 | 5.4 | 11.4 |
| 13 | 9.8 | 4.5 | 13.2 |
| 14 | 12.1 | 3.5 | 13.5 |
| 15 | 12.5 | 3.2 | 15.5 |
| 16 | 11.4 | 4.2 | 14.5 |
| 17 | 9.1 | 5.6 | 8.9 |
| 18 | 9.8 | 4.7 | 12.3 |
| 19 | 10.2 | 4.2 | 12.3 |
| 20 | 9.7 | 4.6 | 12.4 |

Embodiment 2

The following metals, Fe, Co, C, Al, Si, Ti, V, Cr, Mn, Ni, Cu, Ga, Zr, Nb, Mo, Ag, Pt, Au, Pb, B, Nd, Pr, Dy, Tb having a purity of 99.5% or above were used according to the compositions No. 1~20 in Table 4, the total weight thereof being measured such that it was 30 g, the metals being placed in a quartz crucible having a slit measuring 0.3 mm×8 mm in the base thereof and being melted by high-frequency heating in an Ar atmosphere held at the rapid cooling atmospheric pressure indicated in Table 4.

After setting the molten temperature of the resulting alloy to 1300° C., the surface of the molten alloy was reduced to room temperature whilst applying pressure by Ar gas, and the molten alloy was cast in a continuous fashion from a height of 0.7 mm onto the outer surface of a rotating Cu roll, at the roll circumference speed and in the rapid cooling atmosphere conditions indicated in Table 4, thereby yielding continuous rapidly cooled alloy thin strip having a width of 8 mm and an average thickness of 10 μm~100 μm. It was confirmed by means of powder XRD diffraction that all of the rapidly cooled alloy thin strip thus obtained was amorphous. The average thickness of the rapidly cooled alloy thin strip obtained is indicated in Table 5.

This continuous rapidly cooled thin strip was formed into rapidly cooled alloy thin plates having a surface of 5 mm×5 mm by punch processing using a 5 mm×5 mm punch, whereupon the plates were held for 10 minutes at the heat treatment temperature shown in Table 1, in an Ar gas flow, and they were then cooled to room temperature, thereby yielding thin permanent magnets having a surface measuring 5 mm×5 mm.

These thin permanent magnets having a surface measuring 5 mm×5 mm were layered together to form an average thickness of 0.2 mm, whereupon the adjoining surfaces of the thin permanent magnets were impregnated with epoxy resin such that the content of epoxy resin was 1 wt %, and then the magnets were then subjected to a hardening process for 1 hour at 150° C. in a drying vessel in an air atmosphere, thereby yielding a permanent magnet measuring 5 mm×5 mm×0.2 mm.

The magnetic properties of this magnet after magnetization by a 60 kOe pulse magnetizing field in the height direction of the permanent magnet (perpendicular direction to the 5 mm×5 mm surface) were evaluated in a closed magnetic path by means of a BH tracer. The magnetic properties of the magnet are shown in Table 6. In No. 3~No. 20, it was confirmed that the Co, Al, Si, Ti, V, Cr, Mn, Ni, Cu, Ga, Zr, Nb, Mo, Ag, Pt, Au or Pb, replaced a portion of the Fe in each of the compositional phases. FIG. 1 shows powder X-ray diffraction patterns before and after crystallization heat treatment for No. 2 in Table 4.

Embodiment 3

An inorganic adhesive material Aron Ceramic D (product name, Toa Gosei Kagaku Kogyo Co. Ltd.) obtained by dissolving alumina in a solvent was coated onto the surface of a rapidly cooled alloy thin strip of composition No. 1~No. 20 obtained by means of the rapid cooling conditions shown in Table 4, strips were layered to form dimensions of 5 mm×5 mm×0.2 mm, similarly to Embodiment 2 and left for 1 hour at 150° C., thereby causing the inorganic adhesive to set, whereupon the strips were held for 30 minutes at the heat treatment temperature indicated in Table 1, in an Ar gas flow, and then cooled to room temperature, thereby yielding a layered permanent magnet measuring 0.5 mm×0.5 mm×0.2 mm.

The magnetic properties of this magnet after magnetization by a 60 kOe pulse magnetizing field in the height direction of the permanent magnet (perpendicular direction to the 5 mm×5 mm surface) were evaluated in a closed magnetic path by means of a BH tracer. The magnetic properties of the magnet are shown in Table 6. In No. 4~No. 20, it was confirmed that the Co, Al, Si, Ti, V, Cr, Mn, Ni, Cu, Ga, Zr, Nb, Mo, Ag, Pt, Au or Pb, replaced a portion of the Fe in each of the compositional phases.

TABLE 4

| | Composition (at %) | | | | Roll Circumference Speed | Rapid Cooling Atmospheric Pressure | Heat Treatment Temperature |
|---|---|---|---|---|---|---|---|
| | Fe | A | R | M | m/sec | kPa | ° C. |
| | | | | Embodiment 2 | | | |
| 1 | 79.5 | B18.5 | Nd2 | — | 30 | 1.3 | 590 |
| 2 | 78.5 | B18.5 | Nd3 | — | 30 | 1.3 | 620 |
| 3 | 75 + Co3 | B17.5 | Nd3.5 + Pr1 | — | 40 | 1.3 | 640 |
| 4 | 70 + Co2 | B20 | Nd5 | V3 | 20 | 1.3 | 660 |
| 5 | 77 + Co3 | B15.5 | Nd4 | Zr0.5 | 20 | 1.3 | 640 |
| 6 | 66 + Co5 | B18.5 | Nd5.5 | Cr5 | 10 | 10 | 700 |
| 7 | 78 | B17 | Nd3 | Al2 | 20 | 10 | 600 |
| 8 | 76.5 | B18.5 | Nd4 | Si1 | 20 | 10 | 680 |
| 9 | 69 | B18.5 | Nd3.5 + Dy1 | Mn1 | 40 | 10 | 640 |
| 10 | 76 | B15 + C3 | Nd4.5 | Ni1.5 | 40 | 20 | 660 |
| 11 | 75 | B15 + C5 | Nd2.5 + Pr1 | Cu1.5 | 30 | 20 | 610 |
| 12 | 77 | B18.5 | Nd2 + Dy2 | Nb0.5 | 15 | 20 | 620 |
| 13 | 75.5 | B18.5 | Nd2 + Pr3 | Ga1 | 40 | 20 | 660 |
| 14 | 76.5 | B18.5 | Nd4 | Ag1 | 30 | 20 | 660 |
| 15 | 78 | B18 | Nd3.5 | Pt0.5 | 20 | 25 | 600 |
| 16 | 76.5 | B18.5 | Nd4.5 | Au0.5 | 20 | 25 | 640 |
| 17 | 75.5 | B18.5 | Nd4.5 + Tb0.5 | Pb1 | 50 | 30 | 680 |
| 18 | 75 | B7 + C10 | Nd5 | Pb3 | 40 | 1.3 | 640 |
| 19 | 75.5 | B18.5 | Nd5 | Ti1 | 40 | 1.3 | 650 |
| 20 | 77.5 | B15 + C2 | Nd4.5 | Ti1 | 40 | 1.3 | 640 |

TABLE 5

| | Average Thickness of Rapidly Cooled Thin Sheet μm |
|---|---|
| | Embodiment 2 |
| 1 | 30 |
| 2 | 35 |
| 3 | 30 |
| 4 | 60 |
| 5 | 70 |
| 6 | 100 |
| 7 | 55 |
| 8 | 60 |
| 9 | 27 |
| 10 | 25 |
| 11 | 30 |
| 12 | 80 |
| 13 | 20 |
| 14 | 33 |
| 15 | 65 |
| 16 | 54 |
| 17 | 10 |
| 18 | 20 |
| 19 | 25 |
| 20 | 20 |

TABLE 6

| | Magnetic Properties | | |
|---|---|---|---|
| | Br (kG) | iHc (kOe) | (BH)max (MGOe) |
| | Embodiment 2 | | |
| 1 | 13.6 | 2.0 | 10.1 |
| 2 | 11.9 | 2.7 | 11.3 |
| 3 | 9.7 | 4.2 | 11.0 |
| 4 | 9.5 | 6.0 | 9.4 |
| 5 | 12.0 | 4.5 | 12.1 |
| 6 | 9.8 | 6.9 | 11.7 |
| 7 | 12.4 | 3.0 | 14.4 |
| 8 | 11.4 | 3.5 | 14.5 |
| 9 | 10.3 | 4.0 | 12.8 |
| 10 | 10.7 | 4.4 | 12.5 |
| 11 | 11.8 | 3.3 | 13.2 |
| 12 | 10.4 | 5.4 | 10.8 |
| 13 | 9.6 | 4.5 | 12.7 |
| 14 | 11.8 | 3.5 | 12.9 |
| 15 | 12.0 | 3.2 | 14.6 |
| 16 | 11.0 | 4.1 | 13.8 |
| 17 | 9.1 | 5.6 | 8.9 |
| 18 | 9.6 | 4.6 | 12.1 |
| 19 | 10.1 | 4.2 | 12.2 |
| 20 | 9.5 | 4.5 | 12.3 |

Embodiment 4

The following metals, Fe, Co, C, Al, Si, Ti, V, Cr, Mn, Ni, Cu, Ga, Zr, Nb, Mo, Ag, Pt, Au, Pb, B, Nd, Pr, Dy, Tb having a purity of 99.5% or above were used according to the compositions No. 1~20 in Table 7, the total weight thereof being measured such that it was 30 g, and the metals were placed in a quartz crucible having a slit measuring 0.3 mm×8 mm in the base thereof and were melted by high-frequency heating in an Ar atmosphere held at the rapid cooling atmospheric pressure indicated in Table 7.

After setting the molten temperature of the resulting alloy to 1300° C., the surface of the molten alloy was reduced to room temperature whilst applying pressure by Ar gas, and the molten alloy was cast in a continuous fashion from a height of 0.7 mm onto the outer surface of a rotating Cu roll, at the roll circumference speed and in the rapid cooling atmosphere conditions indicated in Table 7, thereby yielding continuous rapidly cooled alloy thin strip having a width of 8 mm and an average thickness of 10 μm~100 μm. It was confirmed by means of powder XRD diffraction that all of the rapidly cooled alloy thin strip thus obtained was amorphous. The average thickness of the rapidly cooled alloy thin strip obtained is indicated in Table 8.

This continuous rapidly cooled alloy thin strip was cut into thin strips measuring 8 mm width by 30 mm length, whereupon Zn of 99.9% purity was vapour deposited onto the rapidly cooled thin strip to a thickness of 2 μm at a film growth rate of 0.15 μm/min.

Figure 2:
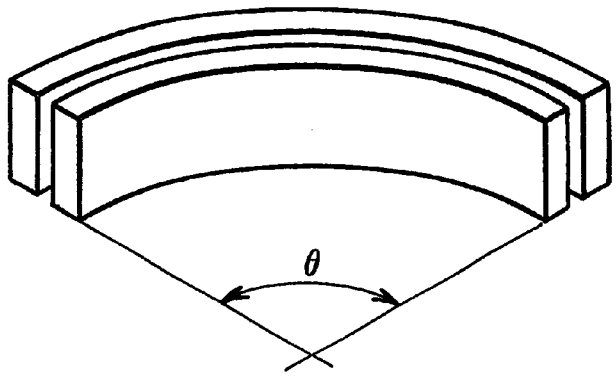
FIG. 2 is an oblique illustrative view of a holding tool made from SUS for bending the amorphous thin strip used in this invention.
Figure 3:
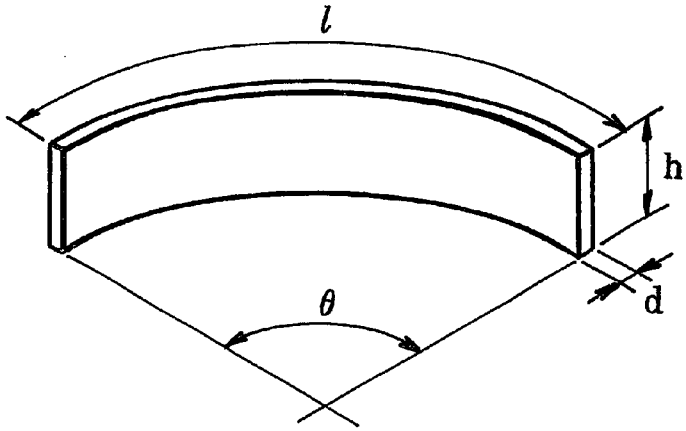
FIG. 3 is an oblique illustrative view of an arc-shaped permanent magnet according to this invention.

Next, such rapidly cooled thin strips onto which Zn had been deposited were layered together to form a thickness of 0.5 mm, whereupon the layered thin strips were inserted and fixed between two curved SUS holding tools as illustrated in FIG. 2, held in this state for 30 minutes at the heat treatment temperature indicated in Table 1, in an Ar gas flow, and then cooled to room temperature, thereby yielding an arc-shaped permanent magnet as illustrated in FIG. 3, having thickness d=0.5 mm, width h=8 mm, length of arc l=30 mm, angle of opening θ=90°, wherein the thin strips are bonded together by means of the melted Zn.

Figure 4:
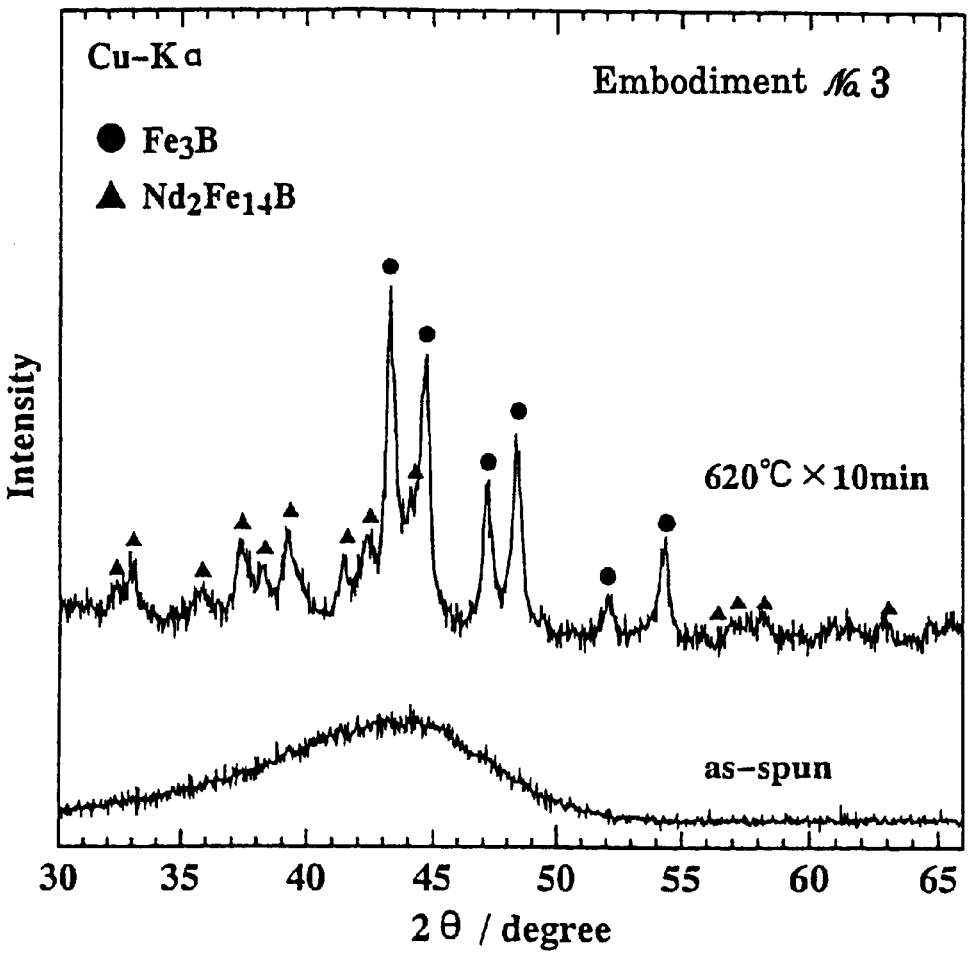
FIG. 4 is a graph showing powder X-ray diffraction patterns before and after crystallization heat treatment of the rapidly cooled alloy thin strip according to No. 3 in Table 7.

The magnetic properties of this magnet after magnetization by a 60 kOe pulse magnetizing field in a direction parallel to the width direction of the arc-shaped permanent magnet were evaluated in a closed magnetic path by means of a BH tracer. The magnetic properties of the magnet are shown in Table 9. In No. 4~No. 20, it was confirmed that the Co, Al, Si, Ti, V, Cr, Mn, Ni, Cu, Ga, Zr, Nb, Mo, Ag, Pt, Au or Pb replaced a portion of the Fe in each of the compositional phases. FIG. 4 shows powder X-ray diffraction patterns before and after crystallization heat treatment for No. 3 in Table 7.

Embodiment 5

Rapidly cooled alloy thin strip obtained by means of the rapid cooling conditions shown in Table 7 was cut into rapidly cooled alloy thin plates measuring 8 mm width and 30 mm length, similarly to Embodiment 4, whereupon an inorganic adhesive material Aron Ceramic D (product name, Toa Gosei Kagaku Kogyo Co. Ltd.) obtained by dissolving alumina in a solvent was coated onto the surfaces of the rapidly cooled alloy thin plates.

Next, these rapidly cooled alloy thin strips were layered to form a thickness of 0.5 mm, whereupon the layered thin strips were inserted and fixed between two curved SUS holding tools as illustrated in FIG. 2, held in this state for 1 hour at 150° C., thereby causing the inorganic adhesive to set, held further for 30 minutes at the heat treatment temperature indicated in Table 1, in an Ar gas flow, and then cooled to room temperature, thereby yielding an arc-shaped permanent magnet as illustrated in FIG. 3, having thickness d=0.5 mm, width h=8 mm, length of arc l=30 mm, angle of opening θ=90°.

The magnetic properties of this magnet after magnetization by a 60 kOe pulse magnetizing field in a direction parallel to the width direction of the arc-shaped permanent magnet were evaluated in a closed magnetic path by means of a BH tracer. The magnetic properties of the magnet are shown in Table 4. In No. 4~No. 20, it was confirmed that the Co, Al, Si, Ti, V, Cr, Mn, Ni, Cu, Ga, Zr, Nb, Mo, Ag, Pt, Au or Pb, replaced a portion of the Fe in each of the compositional phases. FIG. 4 shows powder X-ray diffraction patterns before and after crystallization heat treatment for No. 3 in Table 7.

Embodiment 6

Rapidly cooled alloy thin strip obtained by means of the rapid cooling conditions shown in Table 7 was cut into rapidly cooled alloy thin plates measuring 8 mm width and 30 mm length, similarly to Embodiment 4, whereupon these rapidly cooled alloy thin plates were layered to form a thickness of 0.5 mm, and the layered thin strips were inserted and fixed between two curved SUS holding tools as illustrated in FIG. 2, held in this state for 30 minutes at the heat treatment temperature indicated in Table 7, in an Ar gas flow, and then cooled to room temperature, thereby yielding an arc-shaped permanent magnet comprising layered thin strips which had undergone crystallization.

Next, this magnet was immersed in a solvent bath containing epoxy resin diluted in methylethyl ketone to a concentration of 10 wt %, whereupon it was dried and held at 150° C. for 1 hour in an air atmosphere, such that the epoxy resin hardened, thereby bonding the layered thin strips together and yielding an arc-shaped permanent magnet as illustrated in FIG. 3.

The magnetic properties of this magnet after magnetization by a 60 kOe pulse magnetizing field in a direction parallel to the width direction of the arc-shaped permanent magnet were evaluated in a closed magnetic path by means of a BH tracer. The magnetic properties of the magnet are shown in Table 9. In No. 4~No. 20, it was confirmed that the Co, Al, Si, Ti, V, Cr, Mn, Ni, Cu, Ga, Zr, Nb, Mo, Ag, Pt, Au or Pb replaced a portion of the Fe in each of the compositional phases.

TABLE 8-continued

| | Average Thickness of Rapidly Cooled Thin Sheet μm |
|---|---|
| 6 | 100 |
| 7 | 55 |
| 8 | 60 |
| 9 | 27 |
| 10 | 25 |
| 11 | 30 |
| 12 | 80 |
| 13 | 20 |
| 14 | 33 |
| 15 | 65 |
| 16 | 54 |
| 17 | 10 |
| 18 | 20 |
| 19 | 25 |
| 20 | 20 |

TABLE 7

| | Composition (at %) | | | | Roll Circumference Speed | Rapid Cooling Atmospheric Pressure | Heat Treatment Temperature |
|---|---|---|---|---|---|---|---|
| | Fe | A | R | M | m/sec | kPa | ° C. |
| | | | | Embodiment 4 | | | |
| 1 | 79.5 | B18.5 | Nd2 | — | 30 | 1.3 | 590 |
| 2 | 78.5 | B18.5 | Nd3 | — | 30 | 1.3 | 620 |
| 3 | 75 + Co3 | B17.5 | Nd3.5 + Pr1 | — | 40 | 1.3 | 640 |
| 4 | 70 + Co2 | B20 | Nd5 | V3 | 20 | 1.3 | 660 |
| 5 | 77 + Co3 | B15.5 | Nd4 | Zr0.5 | 20 | 1.3 | 640 |
| 6 | 66 + Co5 | B18.5 | Nd5.5 | Cr5 | 10 | 10 | 700 |
| 7 | 78 | B17 | Nd3 | Al2 | 20 | 10 | 600 |
| 8 | 76.5 | B18.5 | Nd4 | Si1 | 20 | 10 | 680 |
| 9 | 69 | B18.5 | Nd3.5 + Dy1 | Mn1 | 40 | 10 | 640 |
| 10 | 76 | B15 + C3 | Nd4.5 | Ni1.5 | 40 | 20 | 660 |
| 11 | 75 | B15 + C5 | Nd2.5 + Pr1 | Cu1.5 | 30 | 20 | 610 |
| 12 | 77 | B18.5 | Nd2 + Dy2 | Nb0.5 | 15 | 20 | 620 |
| 13 | 75.5 | B18.5 | Nd2 + Pr3 | Ga1 | 40 | 20 | 660 |
| 14 | 76.5 | B18.5 | Nd4 | Ag1 | 30 | 20 | 660 |
| 15 | 78 | B18 | Nd3.5 | Pt0.5 | 20 | 25 | 600 |
| 16 | 76.5 | B18.5 | Nd4.5 | Au0.5 | 20 | 25 | 640 |
| 17 | 75.5 | B18.5 | Nd4.5 + Tb0.5 | Pb1 | 50 | 30 | 680 |
| 18 | 75 | B7 + C10 | Nd5 | Pb3 | 40 | 1.3 | 640 |
| 19 | 75.5 | B18.5 | Nd5 | Ti1 | 40 | 1.3 | 650 |
| 20 | 77.5 | B15 + C2 | Nd4.5 | Ti1 | 40 | 1.3 | 640 |

TABLE 8

| | Average Thickness of Rapidly Cooled Thin Sheet μm |
|---|---|
| | Embodiment 4 |
| 1 | 30 |
| 2 | 35 |
| 3 | 30 |
| 4 | 60 |
| 5 | 70 |

TABLE 9

| | Embodiment 4 | | |
|---|---|---|---|
| | Magnetic Properties | | |
| | Br (kG) | iHc (kOe) | (BH)max (MGOe) |
| 1 | 13.9 | 2.0 | 10.6 |
| 2 | 12.2 | 2.7 | 11.9 |
| 3 | 10.0 | 4.3 | 11.6 |
| 4 | 9.9 | 6.2 | 10.0 |

TABLE 9-continued

| Embodiment 4 | | | |
|---|---|---|---|
| | Magnetic Properties | | |
| | Br (kG) | iHc (kOe) | (BH)max (MGOe) |
| 5 | 12.6 | 4.5 | 12.9 |
| 6 | 10.5 | 7.1 | 12.6 |
| 7 | 12.9 | 3.1 | 15.4 |
| 8 | 12.1 | 3.5 | 15.4 |
| 9 | 10.6 | 4.0 | 13.4 |
| 10 | 11.0 | 4.5 | 13.1 |
| 11 | 12.2 | 3.5 | 13.9 |
| 12 | 11.4 | 5.4 | 11.4 |
| 13 | 9.8 | 4.5 | 13.2 |
| 14 | 12.1 | 3.5 | 13.5 |
| 15 | 12.5 | 3.2 | 15.5 |
| 16 | 11.4 | 4.2 | 14.5 |
| 17 | 9.1 | 5.6 | 8.9 |
| 18 | 9.8 | 4.7 | 12.3 |
| 19 | 10.2 | 4.2 | 12.3 |
| 20 | 9.7 | 4.6 | 12.4 |

Embodiment 7

The following metals, Fe, Co, C, Al, Si, Ti, V, Cr, Mn, Ni, Cu, Ga, Zr, Nb, Mo, Ag, Pt, Au, Pb, B, Nd, Pr, Dy, Tb having a purity of 99.5% or above were used according to the compositions No. 1~20 in Table 10, the total weight thereof being measured such that it was 30 g, and the metals were placed in a quartz crucible having a slit measuring 0.3 mm×8 mm in the base thereof and were melted by high-frequency heating in an Ar atmosphere held at the rapid cooling atmospheric pressure indicated in Table 10.

After setting the molten temperature of the resulting alloy to 1300° C., the surface of the molten alloy was reduced to room temperature whilst applying pressure by Ar gas, and the molten alloy was cast in a continuous fashion from a height of 0.7 mm onto the outer surface of a rotating Cu roll, at the roll circumference speed and in the rapid cooling atmosphere conditions indicated in Table 10, thereby yielding continuous rapidly cooled alloy thin strip having a width of 8 mm and an average thickness of 10 $\mu$m~100 $\mu$m. It was confirmed by means of powder XRD diffraction that all of the rapidly cooled alloy thin strip thus obtained was amorphous. The average thickness of the rapidly cooled alloy thin strip obtained is indicated in Table 8.

Figure 5:
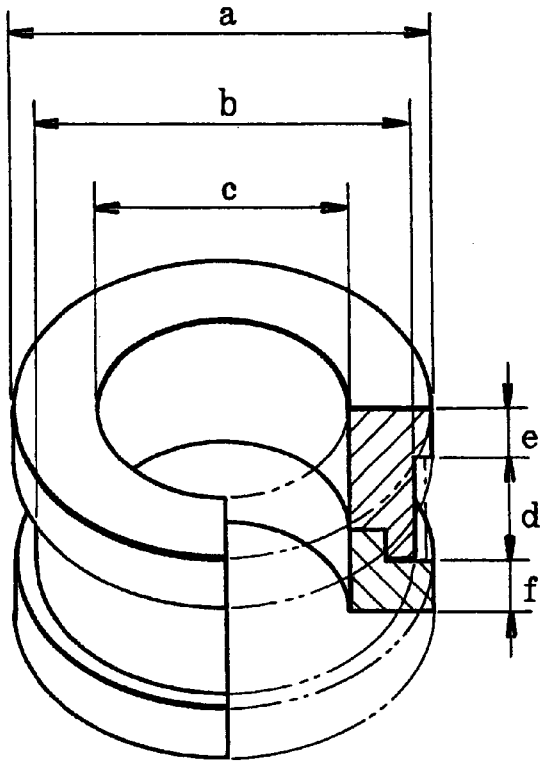
FIG. 5 is an oblique diagram of a ring-shaped holding tool made from SUS for coiling the amorphous thin strip according to this invention into a toroidal shape.
Figure 6:
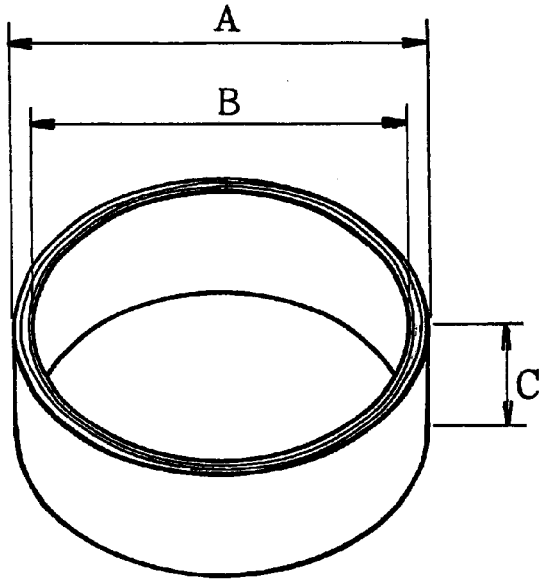
FIG. 6 is an oblique diagram of a ring-shaped permanent magnet according to this invention.

This continuous rapidly cooled alloy thin strip was wound into a toroidal shape about a SUS ring tool as illustrated in FIG. 5, such that it formed an average thickness of 0.5 mm, and the outer circumference thereof was fixed, in which state the strip was held for 30 minutes at the heat treatment temperature shown in Table 10, in an Ar gas flow, and then cooled to room temperature, thereby yielding a ring-shaped permanent magnet as shown in FIG. 6 having an outer diameter A of 21 mm, internal diameter B of 20 mm, width C of 8 mm and average thickness 0.5 mm, wound about a SUS ring. The tool in FIG. 5 had the following dimensions: a=22 mm; b=20 mm; c=12 mm; d=8 mm; e, f=5 mm.

The magnetic properties of this magnet after magnetization by a 60 kOe pulse magnetizing field in a direction parallel to the width direction of the arc-shaped permanent magnet were evaluated in a closed magnetic path by means of a BH tracer. The magnetic properties of the magnet are shown in Table 12. In No. 4~No. 20, it was confirmed that the Co, Al, Si, Ti, V, Cr, Mn, Ni, Cu, Ga, Zr, Nb, Mo, Ag, Pt, Au or Pb replaced a portion of the Fe in each of the compositional phases. FIG. 3 shows a powder X ray diffraction pattern before and after crystallization heat treatment of composition No. 3 in Table 10.

Embodiment 8

A film of Zn of purity 99.9% was vapour deposited onto rapidly cooled alloy thin strip obtained by means of the rapid cooling conditions given in Table 10, to a thickness of 2 $\mu$m at a film growth rate of 0.15 $\mu$m/min. Thereupon, similarly to Embodiment 7, the continuous rapidly cooled alloy thin strip was wound into a toroidal shape about a SUS ring as illustrated in FIG. 5, such that it formed an average thickness of 0.5 mm, in which state the strip was held for 30 minutes at the heat treatment temperature shown in Table 10, in an Ar gas flow, and then cooled to room temperature, thereby yielding a ring-shaped permanent magnet as shown in FIG. 6 having an outer diameter A of 21 mm, internal diameter B of 20 mm, width C of 8 mm and average thickness 0.5 mm, wherein the alloy thin strips were bonded together by means of the melted Zn.

The magnetic properties of this magnet after magnetization by a 60 kOe pulse magnetizing field in a direction parallel to the width direction of the arc-shaped permanent magnet were evaluated in a closed magnetic path by means of a BH tracer. The magnetic properties of the magnet are shown in Table 13. In No. 4~No. 20 in Table 10, it was confirmed that the Co, Al, Si, Ti, V, Cr, Mn, Ni, Cu, Ga, Zr, Nb, Mo, Ag, Pt, Au or Pb, replaced a portion of the Fe in each of the compositional phases.

Embodiment 9

An inorganic adhesive material Aron Ceramic D (product name, Toa Gosei Kagaku Kogyo Co. Ltd.) obtained by dissolving alumina in a solvent was coated onto the surface of a rapidly cooled alloy thin strip obtained by means of the rapid cooling conditions shown in Table 10, whereupon, the continuous rapidly cooled alloy thin strip was wound into a toroidal shape about a SUS ring as illustrated in FIG. 5, such that it formed an average thickness of 0.5 mm, similarly to Embodiment 7, in which state the strip was held for 1 hour at 150° C., thereby causing the inorganic adhesive to set, held further for 30 minutes at the heat treatment temperature shown in Table 10, in an Ar gas flow, and then cooled to room temperature, thereby yielding a ring-shaped permanent magnet as shown in FIG. 6 having an internal diameter of 20 mm, outer diameter of 21 mm, width of 8 mm and average thickness 0.5 mm.

The magnetic properties of this magnet after magnetization by a 60 kOe pulse magnetizing field in a direction parallel to the width direction of the arc-shaped permanent magnet were evaluated in a closed magnetic path by means of a BH tracer. The magnetic properties of the magnet are shown in Table 5. In No. 4~No. 20 in Table 10, it was confirmed that the Co, Al, Si, Ti, V, Cr, Mn, Ni, Cu, Ga, Zr, Nb, Mo, Ag, Pt, Au or Pb replaced a portion of the Fe in each of the compositional phases.

Embodiment 10

Rapidly cooled alloy thin strip obtained by means of the rapid cooling conditions in Table 10 was fabricated into a ring-shaped permanent magnet having internal diameter of 20 mm, outer diameter of 21 mm, width of 8 mm and average thickness of 0.5 mm wound about a SUS ring, similarly to Embodiment 7. Next, this magnet was immersed in a solvent tank containing epoxy resin diluted to 10 wt % concentration in methylethyl ketone, whereupon it was dried and held for 1 hour at 150° C. in an air atmosphere, such that the epoxy resin hardened, thereby bonding together the layered thin strip and yielding a ring-shaped permanent magnet as illustrated in FIG. 6.

The magnetic properties of this magnet after magnetization by a 60 kOe pulse magnetizing field in a direction parallel to the width direction of the arc-shaped permanent magnet were evaluated in a closed magnetic path by means of a BH tracer. The magnetic properties of the magnet are shown in Table 6. In No. 4~No. 20 in Table 10, it was confirmed that the Co, Al, Si, Ti, V, Cr, Mn, Ni, Cu, Ga, Zr, Nb, Mo, Ag, Pt, Au or Pb, replaced a portion of the Fe in each of the compositional phases.

TABLE 10

Embodiment 7

| | Composition (at %) | | | | Roll Circumference Speed | Rapid Cooling Atmospheric Pressure | Heat Treatment Temperature |
|---|---|---|---|---|---|---|---|
| | Fe | A | R | M | m/sec | kPa | ° C. |
| 1 | 79.5 | B18.5 | Nd2 | — | 30 | 1.3 | 590 |
| 2 | 78.5 | B18.5 | Nd3 | — | 30 | 1.3 | 620 |
| 3 | 75 + Co3 | B17.5 | Nd3.5 + Pr1 | — | 40 | 1.3 | 640 |
| 4 | 70 + Co2 | B20 | Nd5 | V3 | 20 | 1.3 | 660 |
| 5 | 77 + Co3 | B15.5 | Nd4 | Zr0.5 | 20 | 1.3 | 640 |
| 6 | 66 + Co5 | B18.5 | Nd5.5 | Cr5 | 10 | 10 | 700 |
| 7 | 78 | B17 | Nd3 | A12 | 20 | 10 | 600 |
| 8 | 76.5 | B18.5 | Nd4 | Si1 | 20 | 10 | 680 |
| 9 | 69 | B18.5 | Nd3.5 + Dy1 | Mn1 | 40 | 10 | 640 |
| 10 | 76 | B15 + C3 | Nd4.5 | Ni1.5 | 40 | 20 | 660 |
| 11 | 75 | B15 + C5 | Nd2.5 + Pr1 | Cu1.5 | 30 | 20 | 610 |
| 12 | 77 | B18.5 | Nd2 + Dy2 | Nb0.5 | 15 | 20 | 620 |
| 13 | 75.5 | B18.5 | Nd2 + Pr3 | Ga1 | 40 | 20 | 660 |
| 14 | 76.5 | B18.5 | Nd4 | Ag1 | 30 | 20 | 660 |
| 15 | 78 | B18 | Nd3.5 | Pt0.5 | 20 | 25 | 600 |
| 16 | 76.5 | B18.5 | Nd4.5 | Au0.5 | 20 | 25 | 640 |
| 17 | 75.5 | B18.5 | Nd4.5 + Tb0.5 | Pb1 | 50 | 30 | 680 |
| 18 | 75 | B7 + C10 | Nd5 | Pb3 | 40 | 1.3 | 640 |
| 19 | 75.5 | B18.5 | Nd5 | Ti1 | 40 | 1.3 | 650 |
| 20 | 77.5 | B15 + C2 | Nd4.5 | Ti1 | 40 | 1.3 | 640 |

TABLE 11

Embodiment 7

| | Average Thickness of Rapidly Cooled Thin Sheet μm |
|---|---|
| 1 | 30 |
| 2 | 35 |
| 3 | 30 |
| 4 | 60 |
| 5 | 70 |
| 6 | 100 |
| 7 | 55 |
| 8 | 60 |
| 9 | 27 |
| 10 | 25 |
| 11 | 30 |
| 12 | 80 |
| 13 | 20 |
| 14 | 33 |
| 15 | 65 |
| 16 | 54 |
| 17 | 10 |
| 18 | 20 |
| 19 | 25 |
| 20 | 20 |

TABLE 12

Embodiment 7

| | Magnetic Properties | | |
|---|---|---|---|
| | Br (kG) | iHc (kOe) | (BH)max (MGOe) |
| 1 | 13.6 | 2.0 | 10.2 |
| 2 | 11.4 | 2.7 | 11.0 |
| 3 | 10.0 | 4.3 | 11.3 |
| 4 | 9.2 | 6.2 | 9.6 |
| 5 | 12.0 | 4.5 | 12.2 |
| 6 | 10.1 | 7.1 | 12.0 |

TABLE 12-continued

Embodiment 7

| | Magnetic Properties | | |
|---|---|---|---|
| | Br (kG) | iHc (kOe) | (BH)max (MGOe) |
| 7 | 12.3 | 3.1 | 15.0 |
| 8 | 11.6 | 3.5 | 15.1 |
| 9 | 10.1 | 4.0 | 12.6 |
| 10 | 10.0 | 4.5 | 12.5 |
| 11 | 12.0 | 3.5 | 12.7 |
| 12 | 11.2 | 5.4 | 11.1 |
| 13 | 9.2 | 4.5 | 12.5 |
| 14 | 11.7 | 3.5 | 13.1 |
| 15 | 12.2 | 3.2 | 15.2 |
| 16 | 11.0 | 4.2 | 13.9 |
| 17 | 8.8 | 5.6 | 8.2 |
| 18 | 9.2 | 4.7 | 11.8 |
| 19 | 9.7 | 4.2 | 11.7 |
| 20 | 9.4 | 4.6 | 12.2 |

TABLE 13

Embodiment 7

| | Magnetic Properties | | |
|---|---|---|---|
| | Br (kG) | iHc (kOe) | (BH)max (MGOe) |
| 1 | 13.9 | 2.0 | 10.6 |
| 2 | 12.2 | 2.7 | 11.9 |
| 3 | 10.0 | 4.3 | 11.6 |
| 4 | 9.9 | 6.2 | 10.0 |
| 5 | 12.6 | 4.5 | 12.9 |
| 6 | 10.5 | 7.1 | 12.6 |
| 7 | 12.9 | 3.1 | 15.4 |
| 8 | 12.1 | 3.5 | 15.4 |
| 9 | 10.6 | 4.0 | 13.4 |
| 10 | 11.0 | 4.5 | 13.1 |
| 11 | 12.2 | 3.5 | 13.9 |

TABLE 13-continued

| | Embodiment 7 | | |
|---|---|---|---|
| | Magnetic Properties | | |
| | Br (kG) | iHc (kOe) | (BH)max (MGOe) |
| 12 | 11.4 | 5.4 | 11.4 |
| 13 | 9.8 | 4.5 | 13.2 |
| 14 | 12.1 | 3.5 | 13.5 |
| 15 | 12.5 | 3.2 | 15.5 |
| 16 | 11.4 | 4.2 | 14.5 |
| 17 | 9.1 | 5.6 | 8.9 |
| 18 | 9.8 | 4.7 | 12.3 |
| 19 | 10.2 | 4.2 | 12.3 |
| 20 | 9.7 | 4.6 | 12.4 |

Embodiment 11

The metals Fe, Co, Si, B, Nd and Dy of 99.5% purity or above were used in a composition of $Nd_{45}Dy_{15}Fe_{73}Co_3Si_1B_{18.5}$, their total weight being measured to 30 g, the metals being placed in a quartz crucible having a slit measuring 0.3 mm×8 mm in the base thereof and melted by means of high-frequency heating in an Ar atmosphere held at a rapid cooling atmosphere of 1.3 kPa.

After setting the molten temperature of the resulting alloy to 1300° C., the surface of the molten alloy was reduced to room temperature whilst applying pressure by Ar gas, and the molten alloy was cast in a continuous fashion from a height of 0.7 mm onto the outer surface of a Cu roll rotating at a roll circumference speed of 9 m/s, thereby yielding continuous rapidly cooled alloy thin strip having a width of 5 mm and an average thickness of 100 μm. It was confirmed by means of powder XRD diffraction that all of the rapidly cooled alloy thin strip thus obtained was amorphous.

50~100 sheets of the materials shown in Table 14 were layered together, in the case of the powder, by coating as a slurry in ethyl alcohol and then drying, in the case of the fibre and plates, by interleaving them directly, and in the case of the vapour deposition film, by sputter deposition directly onto the surface of the rapidly cooled alloy surface using a sputtering device. The layers were then pressed under the conditions shown in Table 14 to yield a layered magnet. The magnetic properties of this magnet were are shown in Table 15. Moreover, electrical resistance was measured in the direction of lamination and the perpendicular direction thereto, and the corresponding measurement results are shown in Table 15.

TABLE 14

| | | Press Conditions | | | |
|---|---|---|---|---|---|
| Number | Intermediate Material | Type | Rate of Temperature Rise (° C./min) | Holding Temperature (° C.) | Holding Time (min) |
| 21 | Soda Borosilicate Glass 50 μm Powder | HIP | 10 | 680 | 15 |
| 22 | Silica Alumina Fibre Cloth 100 μm Thick | HIP | 10 | 680 | 20 |
| 23 | Soda Borosilicate Glass 1 μm Sputter Film | HIP | 10 | 680 | 20 |
| 24 | Soda Borosilicate Glass 5 μm Alumina Powder Mixture | HP | 7 | 650 | 20 |

TABLE 14-continued

| | | Press Conditions | | | |
|---|---|---|---|---|---|
| Number | Intermediate Material | Type | Rate of Temperature Rise (° C./min) | Holding Temperature (° C.) | Holding Time (min) |
| 25 | Barium Glass for TV Receiver Tube 50 μm Powder | HP | 7 | 650 | 20 |

TABLE 15

| | Magnetic Propertie | | | |
|---|---|---|---|---|
| Number | Br T | $H_{CJ}$ (kA/m) | (BH)max (kJ/m³) | Sresistivity (μΩm) |
| 21 | 0.54 | 280 | 40 | 70 |
| 22 | 0.48 | 280 | 31 | 120 |
| 23 | 0.63 | 280 | 47 | 60 |
| 24 | 0.58 | 270 | 42 | 90 |
| 25 | 0.52 | 270 | 37 | 70 |

INDUSTRIAL APPLICABILITY

This invention provides, in a simple manner, a high-performance layered permanent magnet of a prescribed shape and a desired thickness of 20 μm or above and having hard magnetic properties of iHc≧2 kOe, Br≧8 kG, without using a method involving crushing and bonded magnet forming processes and without requiring cutting processes after fabrication, by manufacturing rapidly cooled alloy thin strip of amorphous composition which has high tenacity, simple working properties and an average thickness of 10 μm~200 μm, from a molten alloy having a specific composition containing 6 at % of less of rare-earth element and 15 at %~30 at % of boron, by means of specific molten alloy rapid cooling conditions, and then passing the strip through various processes described in the embodiments layering the strip and uniting it into a single body.

Since the layered permanent magnet obtained according to this invention can be used without needing to crush the rapidly cooled alloy thin strip, not only does this improve the problems of oxidation and powder loss which are associated with conventional Nd—Fe—B type bonded magnets, but also, since a higher density can be obtained than in bonded magnets, the magnet has superior magnetic properties, which enables further compactification and performance upgrading in domestic appliances, OA equipment and other electrical apparatus.

What is claimed is:

1. A method for manufacturing a layered permanent magnet for manufacturing a unified permanent magnet of a fine crystal structure having an average crystal grain size of 10 nm to 50 nm, said method comprising the steps of:

processing a molten alloy by a rapid cooling method adopting a rotating roll in an inert gas atmosphere of less than 30 kPa, the molten alloy of which having a formula represented by $Fe_{100-x-y}R_xA_y$, $(Fe_{1-m}Co_m)_{100-x-y}R_xA_y$, $Fe_{100-x-y-z}R_xA_yM_z$, or $(Fe_{1-m}Co_m)_{100-x-y-z}R_xA_yM_z$, wherein R is at least one or two elements selected from the group consisting of Pr, Nd, Dy and Tb; A is one or two elements selected from the group consisting of C and B; and M is at least one or two elements selected from the group consisting of Al, Si, Ti, V, Cr, Mn, Ni, Cu, Ga, Zr, Nb, Mo, Ag, Hf, Ta, W, Pt, Au, Pb, and wherein the symbols x, y, z and m, each for limiting the compositional range, satisfy the values $1 \leqq x < 6$ at %, $15 \leqq y \leqq 30$ at %, $0.01 \leqq z \leqq 7$ at %, $0.01 \leqq m \leqq 0.5$ at %;

forming rapidly cooled thin alloy strips having at least 90% amorphous structure and an average thickness of from 10 $\mu$m to 200 $\mu$m;

laminating the thus formed rapidly cooled thin alloy strips as they are or after working them to be a desired shape to form a layer having a desired thickness;

subjecting the thus formed layer to a crystallization heat treatment at a temperature of 550° C. to 750° C.; and adhering the laminated rapidly cooled thin alloy strips to one another by impregnating them in resin.

2. A method for manufacturing a layered permanent magnet for manufacturing a unified permanent magnet of a fine crystal structure having an average crystal grain size of 10 nm to 50 nm, said method comprising the steps of:

processing a molten alloy by a rapid cooling method adopting a rotating roll in an inert gas atmosphere of less than 30 kPa, the molten alloy of which having a formula represented by $Fe_{100-x-y}R_xA_y$, $(Fe_{1-m}Co_m)_{100-x-y}R_xA_y$, $Fe_{100-x-y-z}R_xA_yM_z$, or $(Fe_{1-m}Co_m)_{100-x-y-z}R_xA_yM_z$, wherein R is at least one or two elements selected from the group consisting of Pr, Nd, Dy and Tb; A is one or two elements selected from the group consisting of C and B; and M is at least one or two elements selected from the group consisting of Al, Si, Ti, V, Cr, Mn, Ni, Cu, Ga, Zr, Nb, Mo, Ag, Hf, Ta, W, Pt, Au, Pb, and wherein the symbols x, y, z and m, each for limiting the compositional range, satisfy the values $1 \leqq x < 6$ at %, $15 \leqq y < 30$ at %, $0.01 \leqq z \leqq 7$ at %, $0.01 \leqq m \leqq 0.5$ at %;

forming rapidly cooled thin alloy strips having at least 90% amorphous structure and an average thickness of from 1 $\mu$m to 200 $\mu$m;

coating a resin or an inorganic adhesive or plating or vapor depositing a metal having a melting point of 200° C. to 550° C. onto the surfaces of the thus formed rapidly cooled thin alloy strips;

laminating the thus coated, plated or vapor deposited rapidly cooled thin alloy strips as they are or after working them to be a desired shape to form a layer having a desired thickness; and subjecting the thus laminated rapidly cooled thin alloy strips to a crystallization heat treatment at a temperature of 550° C. to 750° C. to unify said laminated rapidly cooled thin alloy strips.

3. A method for manufacturing a layered permanent magnet for manufacturing a unified permanent magnet of a fine crystal structure having an average crystal grain size of 10 nm to 50 nm, said method comprising the steps of:

processing a molten alloy by a rapid cooling method adopting a rotating roll in an inert gas atmosphere of less than 30 kPa, the molten alloy of which having a formula represented by $Fe_{100-x-y}R_xA_y$, $(Fe_{1-m}Co_m)_{100-x-y}R_xA_y$, $Fe_{100-x-y-z}R_xA_yM_z$, or $(Fe_{1-m}Co_m)_{100-x-y-z}R_xA_yM_z$, wherein R is at least one or two elements selected from the group consisting of Pr, Nd, Dy and Tb; A is one or two elements selected from the group consisting of C and B; and M is at least one or two elements selected from the group consisting of Al, Si, Ti, V, Cr, Mn, Ni, Cu, Ga, Zr, Nb, Mo, Ag, Hf, Ta, W, Pt, Au, Pb, and wherein the symbols x, y, z and m, each for limiting the compositional range, satisfy the values $1 \leqq x < 6$ at %, $15 \leqq y \leqq 30$ at %, $0.01 \leqq z \leqq 7$ at %, $0.01 \leqq m \leqq 0.5$ at %;

forming rapidly cooled thin alloy strips having at least 90% amorphous structure and an average thickness of from 10 $\mu$m to 200 $\mu$m;

applying, as an electrical insulating layer, an inorganic glass, a ceramic fiber cloth, a ceramic fiber cloth containing an inorganic glass or a mixture of ceramic powder and inorganic glass to the surfaces of the thus formed rapidly cooled thin alloy strips;

laminating the thus obtained rapidly cooled thin alloy strips as they are or after working them to be a desired shape to form a layer having a desired thickness; and subjecting the thus formed layer to a crystallization heat treatment at a temperature of 550° C. to 700° C. to unify said laminated rapidly cooled thin alloy strips.

4. The method for manufacturing a layered permanent magnet according to any of claims 1 to 3, wherein the formed rapidly cooled thin alloy strips are worked to be formed into a ring-shape or toroidal shape.

* * * * *